United States Patent [19]

Watson et al.

[11] 4,405,003

[45] Sep. 20, 1983

[54] UNIVERSAL TABLE

[76] Inventors: Woodroe Watson, c/o George Spector, 3615 Woolworth Bldg., 233 Broadway; George Spector, 3615 Woolworth Bldg., 233 Broadway, both of New York, N.Y. 10007

[21] Appl. No.: 229,761

[22] Filed: Jan. 29, 1981

[51] Int. Cl.[3] ..... B27C 9/04

[52] U.S. Cl. ..... 144/35 R; 144/1 C; 144/286 R; 408/236

[58] Field of Search ..... 144/1 R, 1 C, 1 E, 1 F, 144/1 G, 3 R, 35 R, 35 A, 286 R; 408/136, 235, 236, 237; 83/574

[56] References Cited

U.S. PATENT DOCUMENTS

| | | | |
|---|---|---|---|
| 3,794,089 | 2/1974 | Morse | 144/35 R |
| 3,815,463 | 6/1974 | Allaire | 144/286 R |
| 4,265,283 | 5/1981 | Nash et al. | 144/1 R |
| 4,318,432 | 3/1982 | Howey | 144/35 R |

FOREIGN PATENT DOCUMENTS

| | | | |
|---|---|---|---|
| 744395 | 1/1933 | France | 144/1 C |
| 945656 | 11/1948 | France | 144/1 C |
| 548152 | 9/1942 | United Kingdom | 408/234 |

*Primary Examiner*—W. D. Bray

[57] ABSTRACT

An apparatus that converts a portable hand skill saw or drill into a table mounted skill saw or drill press, the apparatus including a table and a fixture mounted on the table and to which the portable drill is attached, the fixture including a downwardly pivotable control lever similar to such as used on conventional stationary drill presses for moving the drill vertically, and the table including a rotatable turntable and guide fences along which a work is slidable, a hand skill saw being mounted under the turntable.

1 Claim, 4 Drawing Figures

Fig. 1
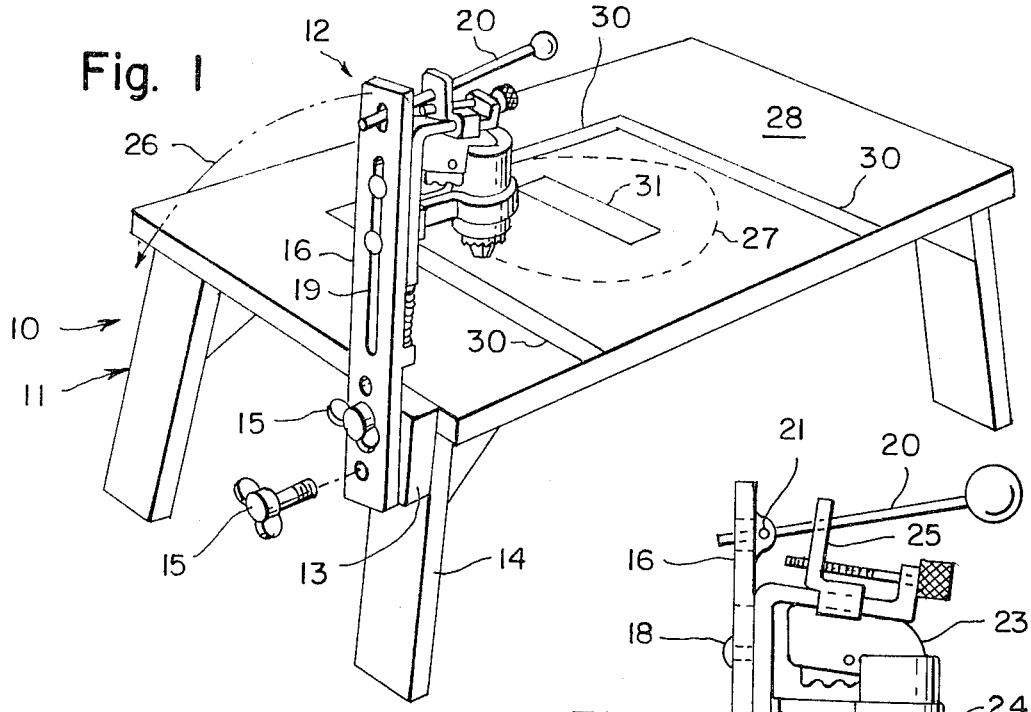
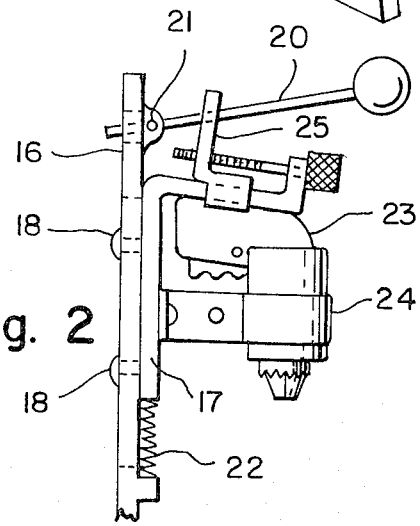
Fig. 2
Fig. 3
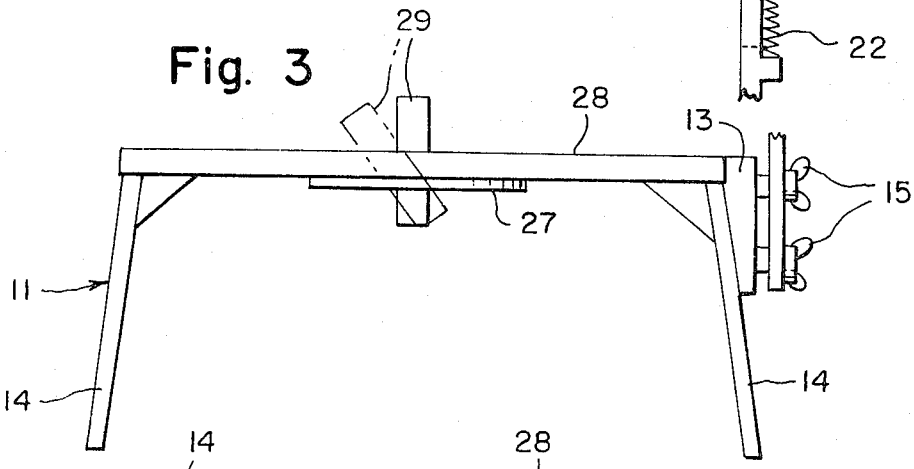
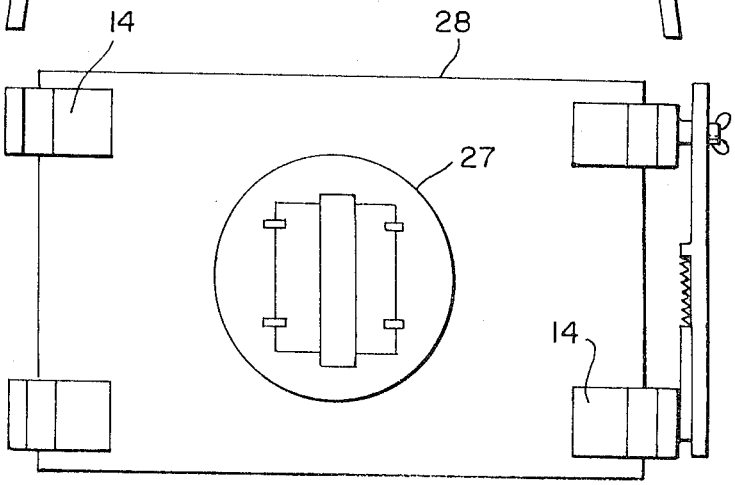
Fig. 4

UNIVERSAL TABLE

This invention relates generally to stationary drill and saw tables.

It is well known that stationary, table mounted saws and drill presses are expensive to purchase, so that many persons confine their purchases only to portable, hand held types of such tools. However, such portable tools cannot produce the accurate work of table mounted tools, and make the job more difficult to accomplish, so that this situation is therefore in need of an improvement.

Accordingly, it is a principal object of the present invention, to provide a universal table to which a portable tool is attachable so that it thus is stationarily supported in order that it does a same work as the expensive table model tools.

Another object is to provide a universal table which thus saves money by eliminating the need to buy table mounted tools.

Yet another object is to provide a universal table to which the portable tools are quickly and easily attached, or detached, so that the tools may alternately be also used portably whenever so wished.

Another object is to provide a universal table which is suitable for either a portable drill, a portable skill saw or other handled held tools to be attached thereto.

FIG. 1 is a perspective view of the universal table.

FIG. 2 is an enlarged detail side view of the drill unit thereof and showing how the drill bit can be lowered into a work, similarly to a conventional drill press, and the portable drill being adjustable for different height of work.

FIG. 3 is a side view of the universal table, and showing in phantom lines the position of the skill saw for angular sawing.

FIG. 4 is a bottom view thereof.

Referring now to the drawing in greater detail, the reference numeral 10 represents a universal table according to the present invention wherein there is a table member 11 and a fixture 12 mounted on the table member. A block 13 mounted on a side of one table leg 14 receives bolts 15 that hold a fixture post 16 upright. An angle bracket 17 is slidable alongside the vertical post 16 of the fixture and includes projecting rivets 18 that slide in a vertical groove 19 of the post. A lever 20 pivoted at one end on a pin 21 supported on the post, serves to push the angle bracket downwardly against a compression spring 22 so as to lower a portable electric drill 23 mounted on the angle bracket by means of a strap 24. The lever bears down against a fitting 25 slidable on the angle bracket in order to adjust the sliding rate and distance of the angle bracket when the lever is swung downwardly.

As shown by arrow 26, the post is pivotable into a horizontal position by removing all except one bolt 15 in order that it pivots thereabout. FIG. 4 shows the post pivoted into a horizontal position.

A turntable 27 at a center of the table top 28 allows a hand, electric skill saw 29 to be mounted to an underside thereof in either a vertical or inclined position (as shown by phantom lines in FIG. 3), the turntable being securable stationarily in selected position. Guide fences 30 allow a work to be slided thereagainst while being fed to the skill saw, if so wished. The skill saw blade projects up through a slot 31 on the turntable.

In use, it is now evident that a portable drill and hand skill saw may thus be readily converted for stationary table use.

While various changes may be made in the detail construction, it is understood that such changes will be within the spirit and scope of the present invention as is defined by the appended claims.

What is claimed:

1. A universal table, comprising in combination, table member and a fixture pivotally mounted on said table, said table including a table top supported upon legs, a turntable at a center of said table top carrying a hand skill saw secured to an underside thereof, and a portable electric drill mounted on said fixture, wherein said fixture comprises a post, a bracket mounted slidably along a slot in said post carrying said portable electric drill, and a pivotable lever mounted on said post vertically above said bracket engaging said bracket to apply downward pressure on said bracket against a spring mounted on said post under said bracket, said bracket including a vertical portion with spaced rivets projecting therefrom through said slot, said bracket also including an integral horizontal portion upon which is mounted a sliding support for said lever, in combination with means for adjusting said support mounted on said horizontal portion, wherein said post is vertically pivotable about said table.

* * * * *